US006684521B2

(12) United States Patent
Rempe

(10) Patent No.: US 6,684,521 B2
(45) **Date of Patent: *Feb. 3, 2004**

(54) SIDING GAUGE TOOL

(76) Inventor: Steve Rempe, 1429 Indian Valley Rd., Novato, CA (US) 94947

( * ) Notice: Subject to any disclaimer, the term of this patent is extended or adjusted under 35 U.S.C. 154(b) by 0 days.

This patent is subject to a terminal disclaimer.

(21) Appl. No.: 10/117,579

(22) Filed: Apr. 5, 2002

(65) Prior Publication Data

US 2002/0170198 A1 Nov. 21, 2002

Related U.S. Application Data

(63) Continuation-in-part of application No. 09/507,472, filed on Feb. 17, 2000, now Pat. No. 6,367,160.

(51) Int. Cl.[7] ..... G01D 21/00; G01B 3/30

(52) U.S. Cl. ..... 33/647; 33/648; 33/649

(58) Field of Search ..... 33/646, 647, 648, 33/649, 411; 52/547, 548, 408, 105, 99

(56) References Cited

U.S. PATENT DOCUMENTS 631,315 A * 8/1899 Meskill ..... 33/647
4,314,429 A * 2/1982 Casteel et al. ..... 33/647
4,425,714 A * 1/1984 Kelly, Jr. ..... 33/646
4,484,392 A * 11/1984 DeFino et al. ..... 33/647
4,654,975 A * 4/1987 Lopez ..... 33/626
4,899,459 A * 2/1990 Taggart ..... 33/646
5,400,519 A * 3/1995 Meyer ..... 33/646
5,522,149 A * 6/1996 Meyer ..... 33/646
6,367,160 B1 * 4/2002 Rempe ..... 33/647
2001/0034952 A1 * 11/2001 Mansfield ..... 33/647

* cited by examiner

*Primary Examiner*—Diego Gutierrez
*Assistant Examiner*—Yaritza Guadalupe
(74) *Attorney, Agent, or Firm*—Arnold S. Weintraub

(57) ABSTRACT

A tool and method for installing siding panels in overlapped relation. The tool comprises a clamp and lip arrangement for clamping and supporting a panel on a previously installed panel, a handle extending from the clamp, a first gauge for setting the overlap between successive panels, a second gauge for marking or drilling nail installation locations, and an arrangement for changing the amount of overlap between successive panels. In use, one or more of the tools are clamped along the bottom edge of a panel being installed and the tool supported by the lip on the upper edge of the previously installed board, enabling the installer to temporarily tack the new panel in place. The tool(s) can then be removed from the new piece by twisting and pulling down on the handle portion. The second gauge is used to mark/drill the nail installation locations, prior to or after tacking.

37 Claims, 5 Drawing Sheets

SIDING GAUGE TOOL

CROSS-REFERENCE TO RELATED APPLICATIONS

This Application is a continuation in part of and claims the benefit under 35 USC Section 120 of the filing date of earlier filed patent application Ser. No. 09/507,472, filed Feb. 17, 2000, now U.S. Pat. No. 6,367,160 the specification of which is hereby incorporated by reference.

BACKGROUND OF THE INVENTION

1. Field of the Invention

This invention relates to the installation of elongated panels, boards and/or siding material in overlapped relation to the vertical wall of a building structure and the provision of a reusable orienting and supporting tool to aid in such installation. Even more particularly, this invention relates to a siding support and installation tool that temporarily grips the siding to be installed and is either preset or adjustable to establish a desired degree of overlap between successive siding panels being secured.

2. Description of the Prior Art

Building siding is well known and in widespread use. Siding material typically is manufactured in elongate boards that must be secured to a building in overlapping fashion. Installation of these boards can be awkward and time consuming, often requiring two or more people. Numerous tools have been designed to assist in siding installation. However, none of the known prior art devices enable simple and efficient installation of a length of siding by one person.

SUMMARY OF THE INVENTION

The siding gauge tool of this invention provides a reusable device that is temporarily placed in gripping relation with a piece of siding to be installed and which, when positioned on the piece of siding, automatically gauges the overlap of the siding with a previously installed piece of siding, eliminating the task of measuring and marking by the installer. Further, although the tool is preset for most uses, the gauge may be incrementally adjusted to change the amount of overlap between the siding panel to be installed relative to the previously installed panel. In addition, although laterally positionable along an edge of the siding to be installed, the tool keeps the siding from slipping during the initial nailing and allows one person to hang, gauge, hold and nail the siding.

The inventive tool includes an elongate base including a handle portion, and a gauge arm and a resilient spring or clip member, the arm and clip each extending upwardly from the base and combining to form a supporting and gripping portion of the tool. The gauge arm extends generally at a right angle to the base and terminates in a lip or flange portion that extends generally at a right angle from the arm and in a direction away from the handle. The clip member is carried on the upper surface of the base, extends toward the gauge arm, and terminates in a deflectable free end. Preferably, the free end is spaced from the gauge arm to define a gap therebetween and the clip member and gauge arm cooperate to define an upwardly open U-shaped channel for receiving an edge portion of a piece of siding. The clip member is deflectable towards (and away from) the gauge arm whereby to expand as needed to receive and clampingly engage with boarding material of different thicknesses.

For use, one or more (and preferably two) of the tools are placed on the bottom edge of the piece of siding or like boarding material to be installed so that the siding member is releasably captured between the spring clip and the gauge arm, and is held there by spring tension, with the bottom edge of the siding being supported or resting on the upper surface of the base. The tool(s) may then be moved and positioned as desired along the lower edge portion of the siding.

According to an aspect of this invention, although the distance between the siding support surface of the base member and the flange member defines a preset gauge length (i.e., the vertical overlap between successively installed siding panels), the vertical overlap between successive siding panels may be adjusted. In this regard, the tool of the invention herein includes a shim arrangement for spacing the siding from the support surface of the base member to reduce the distance between the support surface (on which the bottom edge of the siding to be installed would normally sit) and the flange member, thereby changing the amount of overlap between the bottom edge of the siding panel to be installed and the top edge of the last installed piece of siding.

Preferably, the shim arrangement comprises cylindrical and wedge shaped shims that are supported on the upper surface of the base member. Each such shim may include an axial bore and be removably connected to the base member by a resilient U-shaped mounting clip that is operably associated with the bore and the base member. The wedge shaped shim may be removably secured to the base member by a threaded fastener.

Additionally, the shim arrangement comprises a C-shaped bracket having upper and lower legs juxtaposed with the upper and lower surfaces of the base member, and a threaded stem operably connecting the base member to the lower leg. An adjustable space is defined between the upper leg and the base member for receiving one or more shim plates of desired thickness. The threaded stem includes a free end that engages the lower surface of the base member and a medial portion that is threadably engaged with a bore in the lower leg. Depending on the direction of rotation of the stem member, the upper leg of the bracket member is pulled towards (or pushed away from) the base member and gripping retaining engagement with the shim plate. In some situations, the separately inserted shim plates may be replaced by the upper leg of the bracket. That is, the upper leg may be of a predetermined thickness and function as a shim for the siding, which leg is brought into engagement with the base member and used to space the siding from the base member.

Further and according to this invention, the handle has a free end portion that is "squared" and provided with a score or gauge line and a nail locating aperture. The gauge line is located inwardly from the free end of the handle and extends between opposite lateral edges thereof.

The gauge line is adapted to be aligned with an edge of the siding panel to be installed whereby to locate places in the siding member where installation nails should be placed. The nails are desirably driven into the siding panel at a preset distance inwardly from the long (horizontal) upper and lower edges, such as for overlapping installations and the short (vertical) end edges, such as for butt-joints, to ensure that the siding panel does not crack from nails that are too close to the edges of the siding panel.

The aperture is sized to receive a pencil, awl, or like marking member to mark places in the siding where the installation nails should be placed. Further, the aperture is sized to receive a drill bit and the handle is of a metal (e.g., stainless steel) that enables in situ pre-drilling of one or more nail-receiving holes.

The free-end portion of the handle is of a predetermined thickness to enable the user to ensure that the ends of panels being installed in side-by-side relation (i.e., a butt joint) are properly separated by a vertical gap that may receive a proper amount of caulking material. In this regard, the squared end of the handle is partially rounded to enable caulking material to be smoothed.

The piece of siding is placed at an appropriate position on a wall above (or next to) a piece of siding, so that the flange of the tool rests on the upper edge of the previously installed piece therebelow. The length of the arm portion thus defines the desired overlap of the siding pieces (e.g., one and one-quarter inches). The installer may rest the piece of new siding, with the tool(s) in place, on the previously installed piece of siding, enabling the installer to temporarily nail the new piece in place. The tool(s) can then be removed from the new piece by twisting and pulling down on the handle portion to both disengage the flange from the previous piece, and release the new piece of siding from the spring tension between the clip and arm. The new piece of siding, with the tool(s) now removed, can now be completely nailed in place, and the process repeated with subsequent runs of siding.

The siding gauge tool of this invention enables, in one tool, the vertical overlap between a siding panel being installed relative to the top edge of a previously installed siding panel to be preset by a predetermined amount, the amount of overlap between successive panels to be changed easily, the lateral separation between the abutted ends of a siding panel being installed and previously installed siding to be set by a predetermined amount sufficient to define a narrow vertical cavity of predetermined size for receiving caulking material, and the marking (or in situ drilling) of nail receiving holes at predetermined locations relative to the siding.

When used as a pair (i.e., a tool is positioned at each opposite lateral end portion of a siding panel), the siding gauge tool(s) enables installation of a length of siding by one person. The siding gauge tool is removably attached and/or positioned, as desired, along the bottom edge portion of a free piece of siding, and facilitates the installation of siding with little effort.

The siding gauge tool is simple to use and efficient, unlike other-known siding tools.

The attachment achieved by the spring clip allows flexibility when installing.

The "flange" used for gauging allows for accurate gauging but far less resistance when removing from the installed siding. This "flange" will not cut or scar the siding or boarding material.

BRIEF DESCRIPTION OF THE DRAWINGS

FIG. 2 is an end elevation cross-sectional view of a first piece (course) of siding and starter strip as nailed to a wall.

FIG. 3 is an end elevation view of the inventive tool as placed on the lower edge of a second piece of siding.

FIG. 4 is a perspective view of the second piece of siding bearing two of the inventive tools being positioned on the wall above the first piece of siding.

FIG. 5 is a perspective view of the second piece of siding in position on the wall above the first piece of siding with the second piece of siding attached to the wall only at the top edge and the pair of tools still in place.

FIG. 6 is an end elevational cross-sectional view of the second piece of siding attached to the wall prior to the removal of the inventive tools.

FIGS. 11–15 disclose shim arrangements used in the siding installation tool of FIG. 1 that enables the overlap between siding to be installed and previously installed siding to be changed; in particular:

FIG. 11 is a side view of the siding tool and a wedge shaped shim member positioning the bottom edge of the siding to be installed relative to the tool.

FIG. 14 is a perspective view of the siding tool with a cylindrical spool for positioning the siding and a retention clip for releasably retaining the spool on the tool.

DETAILED DESCRIPTION OF PREFERRED EMBODIMENTS

Figure 1:
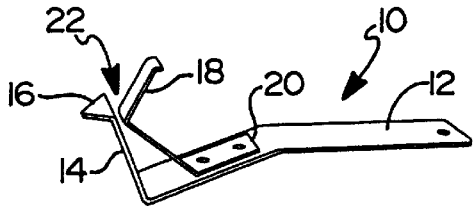
FIG. 1 is a perspective view of the siding gauge tool of this invention.

FIGS. 1–15 are views of a siding gauge tool for assisting in the installation of horizontally overlapping boarding, siding or other elongated panel-like members on a vertically disposed wall "W" of a building or like structure. As will be understood from the description herein, each board or member to be installed has a predetermined thickness, an upper edge portion, a lower edge portion, an interior face and an exposed exterior face extending between the upper and lower edges thereof. When installed to the wall W, such as by a series of nails N, the upper and lower edge portions are generally horizontally extending and the interior and exterior faces are generally parallel to the wall.

Turning now to the drawings, and in particular to FIGS. 1–6, the gauge tool is generally indicated by the number 10. The tool 10 includes an elongate base or handle portion 12, an arm portion 14 extending upwardly preferably at a right angle to the handle portion, and a flange portion 16 extending preferably at a right angle outwardly from the arm portion. A spring or clip member 18 is carried on the upper surface 20 of the base, and extends toward the arm portion 14, preferably to define a gap 22 therebetween (alternatively, the clip member may actually contact the arm). The point of closest extent (or contact) of the clip member to the arm is preferably at least some distance less than the length of the arm portion. The length of the arm portion 14 (i.e., the distance between the flange and the upper surface of the base) defines the amount of overlap between each piece of siding when installed. The extension of the flange portion 16 from the gauge arm is preferably less than the thickness of the siding being installed to enable ease of removability therefrom.

Figure 2:
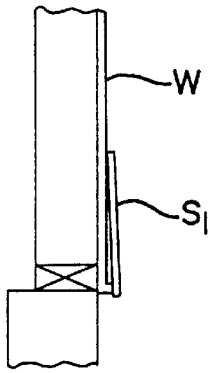
FIGS. 2–6 is a series of views illustrating the use of the inventive tool to install siding to a structure; in particular.
Figure 3:
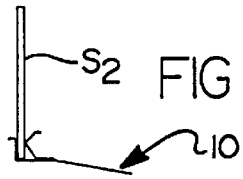
Figure 4:
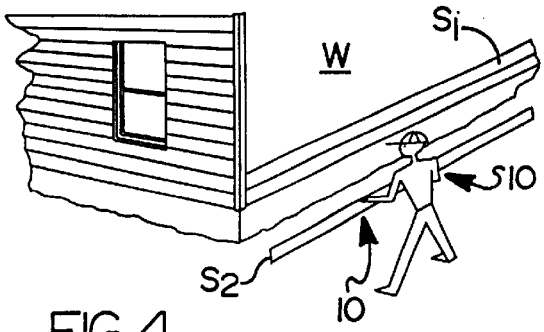
Figure 5:
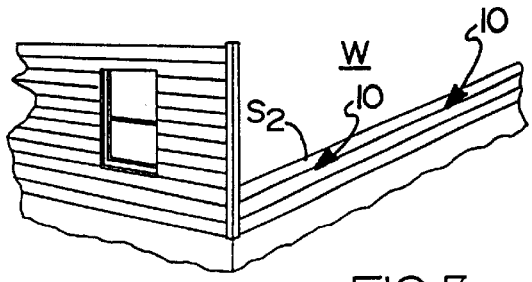
Figure 6:
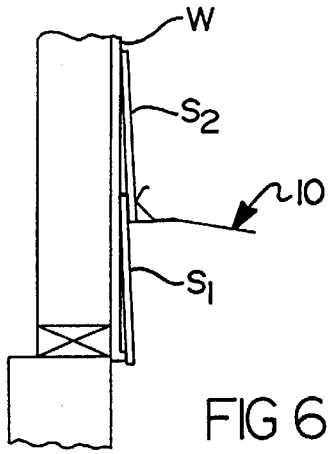

FIGS. 2–6 are a series of views illustrating the use of the inventive tool 10 to install siding to a structure. FIG. 2 is an end elevation cross-sectional view of a first piece (course) of siding $S_1$ and starter strip as nailed to a wall W. FIG. 3 is an end elevation view of the inventive tool 10 as placed on the lower edge of a second piece of siding $S_2$. FIG. 4 is a perspective view of the second piece of siding $S_2$ bearing two of the inventive tools 10 being positioned on the wall W above the first piece of siding $S_1$. FIG. 5 is a perspective view of the second piece of siding $S_2$ in position on the wall above the first piece of siding $S_1$ with the second piece of siding $S_2$ attached to the wall W only at the top edge and the pair of tools 10 still in place. FIG. 6 is an end elevational cross-sectional view of the second piece of siding $S_2$ attached to the wall W prior to the removal of the inventive tools 10.

Instructions for use of the siding gauge tool of this invention may include the following:

First, hang a starter strip and the first course of siding. Cut the next piece of siding to length. Push the siding gauge tool over the bottom edge of the next piece of siding, locating each gauge approximately three feet of the center of the board. Use the siding gauge tools to hang the next piece of siding on the previous course (note that it automatically engages the overlap of each piece of siding while keeping it from slipping during initial nailing). Tack the siding only at the top edge, per the manufacturers specifications and in the vicinity of the siding gauge tools. Do not nail the siding completely prior to removal of the siding gauge tools or removal of the tools will be more difficult. Remove the siding gauge tools by gently twisting and pulling down. Complete the nailing of the siding per the manufacturers specifications. Repeat the above steps for all subsequent courses of siding.

Figure 7:
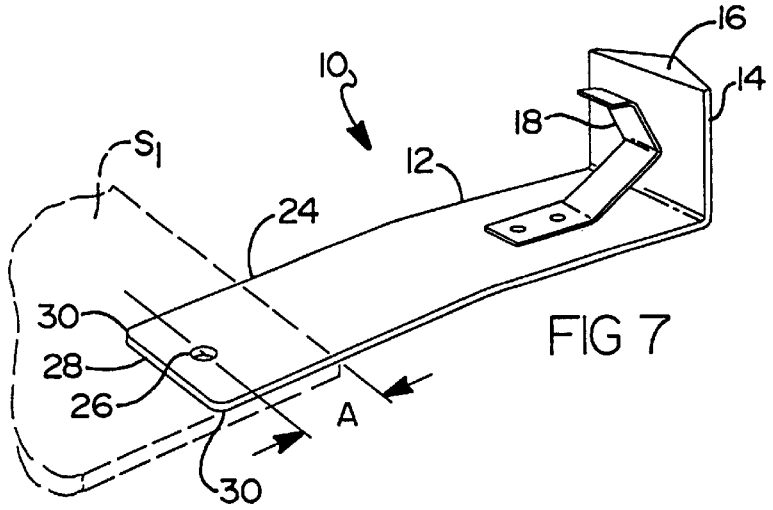
FIG. 7 is a perspective view of yet another alternative embodiment of a gauge tool for assisting in the installation of horizontally overlapping boarding according to this invention.

Turning now to FIG. 7, the gauge tool 10 according to this invention is provided with a nail locating gauge arrangement that is useful in marking locations of the installation nails and/or directly pre-drilling holes in the siding, in situ, the holes receiving the installation nails. According to this invention, the nail locating gauge arrangement includes a gauge aperture 26 and a gauge or score line 24 used for locating the gauge aperture 26 relative to an edge of the siding. $S_2$ (illustrated in phantom). The nail locating gauge arrangement is advantageously used in marking nail installation locations for siding panels to be installed in overlapped relation (i.e., locations inwardly from the elongated edges of the siding being installed) as well as in an end-to-end relation (i.e., laterally inwardly from the short edge of the siding being installed and an end butt joint).

As illustrated in the FIG. 7, the score line 24 and locating gauge aperture 26 are separated from one another by a predetermined amount "A" and each are disposed inwardly from the free end 28 of the grippable handle 12 (i.e., remote to the arm portion 14). The free end 28 of the handle is generally squared and the gauge or score line 24 is generally parallel to and in spaced relation to edge thereof. The locating aperture 26 is closer to the free end 28 of the handle than the score line 24.

In use, and when installing a siding panel $S_2$ above a previously installed siding panel $S_1$, the tools 10 are clamped to the bottom edge of the siding $S_2$ to be installed and their lips 16 rested on the horizontally extending top edge of the previously installed siding $S_1$. The gauge arms 14 automatically position the bottom edge portion of the siding $S_2$ in overlapped relation with the top edge portion of the siding $S_1$. The top edge of the siding $S_2$ is tacked to the wall, whereupon the tools 10 are removed from the siding $S_2$.

The gauge line 24 of a tool 10 is aligned with the top or bottom horizontal edge portions or vertical end of the siding $S_2$ being installed, thereby locating the nail attachment positions for the siding. The user would then insert a pencil, awl, or like element into the aperture 26 to mark the siding panel $S_2$ with the location(s) of the installation nails N for attaching the panel or board to the wall W. The nails N are then driven through the nail locations marked on the top and bottom edge portions of the siding $S_2$, these nails also passing through the top edge portion of the siding $S_1$ previously mounted to the wall W.

In the instance wherein first and second siding panels $S_2$ are to be mounted in overlapped relation to the panel $S_1$, as hereinabove described, and also in side-by-side abutting relation, the first siding panel $S_2$ is nailed in overlapped relation to the siding panel $S_1$. The second siding panel $S_2$ is supported on the panel $S_1$ and the short ends of the two panels $S_2$ positioned in juxtaposition with one another. The free end of the handle is inserted between the short ends, thereby ensuring that the horizontally disposed panels are abutted in side by side relation and laterally separated by the proper amount.

In a preferred embodiment according to his invention, the tool handle 12 is comprised of a metal, such as stainless steel, and is of a predetermined thickness. The handle end is adapted to be inserted between and the short ends (edges) of the panels $S_2$ when the panels are juxtaposed with one another, the handle thickness providing a desired separation or vertical gap between the abutted short ends of the siding panels. Preferably, the thickness is about ⅛ inch. Desirably, being comprised of metal, the handle enables a drill bit to be driven through the gauge aperture and the nail holes to be drilled directly in situ and through overlapped and abutted siding panels.

In a typical siding installation, it is important that a nail be placed no closer than one inch from the top or bottom of the horizontal edge and not closer than ⅜ inch from the end of the siding. The score line is used to locate the nail(s). If the nail hole is located incorrectly and/or if the nail is installed by a pneumatic gun, the siding may break shatter, or otherwise be compromised. Importantly, the handle would be comprised of a stainless steel to enable pre-drilling directly through the aperture and the siding without marking.

Additionally, the corners 28 at the end 28 of the base or handle portion 12 remote to the clip and arm portions 18 and 14 would be rounded or specially contoured, as shown at 30, to enable the user to use the tool as a putty knife to smooth caulking material that is used on joints. In this regard, caulking material may be placed in the vertical separation or gap that is established between the abutted siding panels by the handle being inserted between the short ends of these panels.

Desirably, the gauge tool allows for one-man hands-free installation of boarding such as fiber cement or other lap siding material and facilitates proper spacing with little effort. During the installation, the upwardly open clamping jaw allows the tool to be positioned on the board, and slid laterally along the edge of the board as needed for proper positioning of the board's mass center. Importantly, the lip portion of the tool sits upon but does not pierce, penetrate, or "hook" into or onto the previously installed board, thereby enabling hanging and "twisting" removal of the tool from the board being installed once the board has been "tacked" or otherwise attached to the wall.

Advantageously, the preset gauge length defined between the lip portion and base of the tool enables quick and accurate overlapped placement of successive boards. Further, the preset gauge line 24 enables the installer to accurately position the nail locating gauge aperture 26 relative to the elongated top and/or bottom horizontal edges as well as the short vertical edges of the siding panels. The installation or wall securement nails are driven into the siding panel, at the locations previously marked by the aperture 26, or through holes pre-drilled through the aperture 26.

Figure 9:
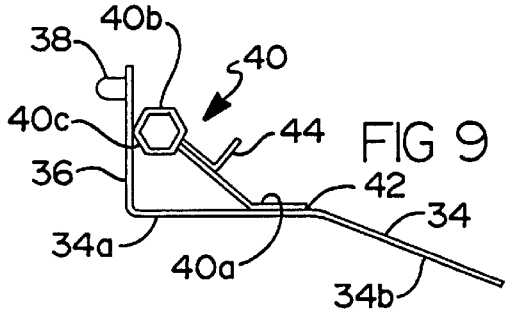
FIG. 9 invention is a side elevation view of the gauge tool shown in FIG. 8.
Figure 10:
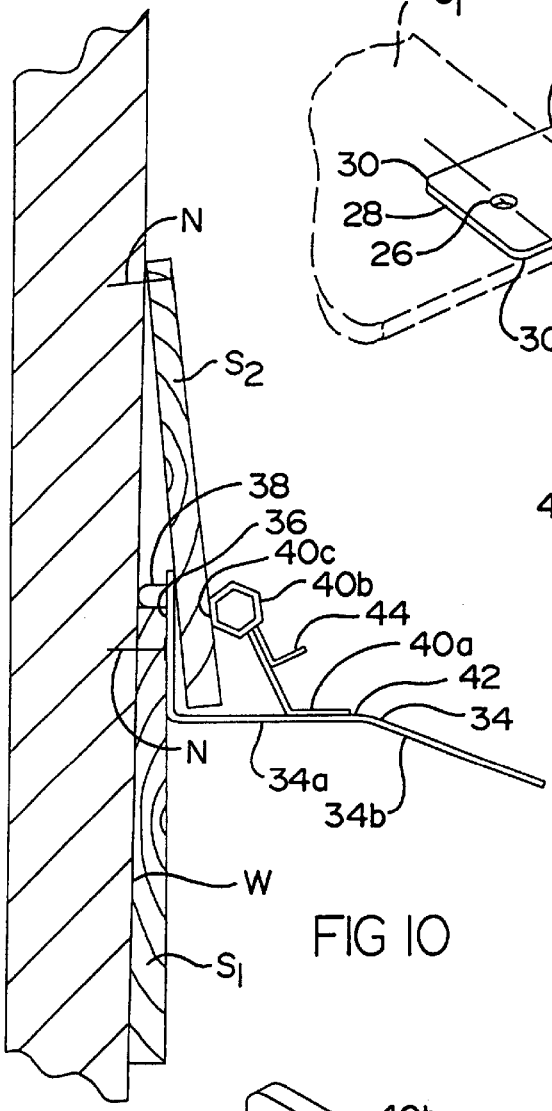
FIG. 10 is a side-elevation view in cross-section of the gauge tool shown in FIG. 8 installing boarding to a structure.
Figure 8:
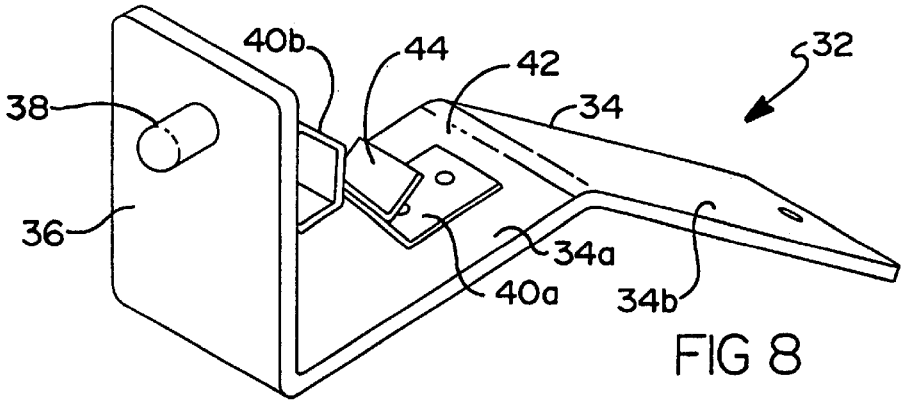
FIG. 8 is a perspective view of an alternative embodiment of a gauge tool for assisting in the installation of horizontally overlapping boarding according to this.

FIGS. 8–10 illustrate an alternate preferred embodiment of a siding gauge tool according to this invention, generally indicated by the number 32. The gauge tool 32 comprises an elongated base or handle 34 formed by first and second generally planar end portions 34*a* and 34*b*, an arm portion 36 extending upwardly preferably at a right angle to the handle end portion 34*a*, and a pin or lip portion 38. The handle end portion 34*b* is grippable by the hand of the user in installing boarding. The pin 38 is generally parallel to the handle end portion 34*a* and extends preferably at a right angle to the arm portion 36 and in a direction outwardly and away from the arm portion 36 of the tool. The distance between the pin 38 and the handle end portion 34*a* defines the overlap between overlapped boarding or siding members.

A resilient spring or clip member 40 is carried on the upper surface 42 of the end portion 34*a* and extends upwardly therefrom and towards the arm portion 36. The clip member 40 is in the form of a deflectable cantilever beam and comprises a plate member 40*a* that is connected to the handle portion 34 and a tube or shaped member 40*b* at the deflectable free end of the beam.

According to this invention, the shaped member 40*b* comprises a generally hexagonally shaped tube having a generally flat surface 40*c* and a geometrical axis that is transverse to the axis of the handle. The flat surface 40*c* is adapted to be biased towards (and flex away from) engagement with the exterior face of the boarding.

Further, a retractor member 44 is operatively connected to the clip member 40. Desirably, the retractor member 44 enables the user to pull the shaped member 40*b* away from the arm member 36 to create a throat (or gap) sufficient to receive the lower edge portion of the boarding to be installed.

As shown in FIGS. 8 and 9, the hexagonal shaped member 40*b* is in a first position, engaging the arm portion 36. In FIG. 10, the hexagonal member 40*b* is in a second position, spaced from the arm portion 36, with the flat face 40*c* member 40*b* engaging the exterior face of the boarding being installed.

The clamping relationship is shown best in reference to the cross-sectional elevation installation view of FIG. 10. Desirably, the flat face 40*c*, the cantilever plate member 40*a*, and the hexagonal shaped member 40*b* are designed to be at an angle such that the flat face 40*c* is biased into complete clamping engagement against the exterior face of the boarding $S_2$.

Preferably and according to this invention, the siding gauge tool is provided with apparatus that enables the siding gauge length to be changed (i.e., adjusted as desired) whereby to change the amount of overlap between a piece of siding to be installed relative to a previously installed piece of siding.

In this regard and referring to FIGS. 11–15, the siding gauge tool 10 is as described herein above but modified to include a shim which is nested into an area of the tool defined above the upper surface of the base member and between the lower end portions of the clip member and the gauge arm proximate to the base member. The shim operates to space the bottom edge of the piece of siding to be installed upwardly and away from the upper surface of the base member and towards the flange and thereby change the amount of vertical overlap between the bottom edge of a piece of the siding being installed relative to the top edge portion of the previously installed piece of siding. In general, the shim is of predetermined thickness, is supported on the upper surface of the base member, and has an upper surface that is operable alone, or movable upwardly by operable apparatus, to support or space the siding from the base member.

Figure 11:
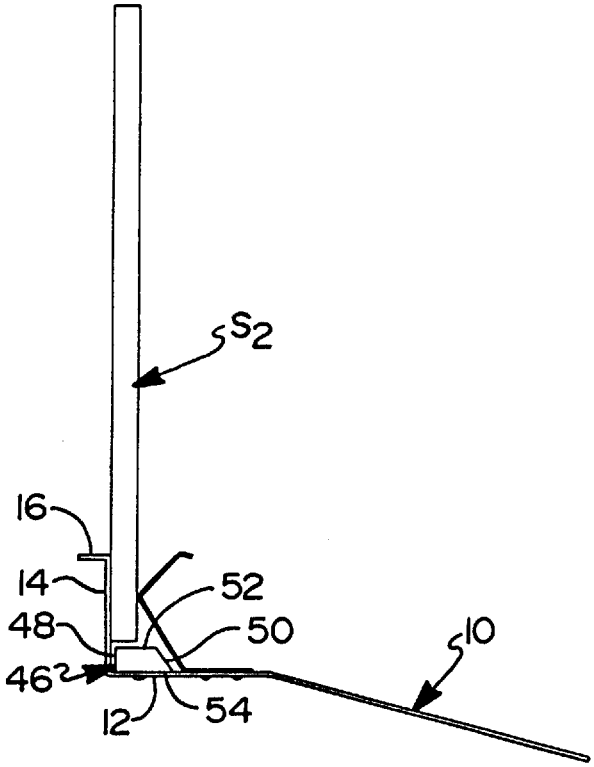

Turning to FIGS. 11–13, the reusable removable siding installation tool 10 is provided with a removable wedge shaped shim member 46 that includes opposed endwalls 48 and 50 that are squared and angled, generally planar upper and lower surfaces 52 and 54, and opposed generally squared lateral sidewalls.

In FIG. 11, the siding gauge tool 10 is modified in that the gauge arm 14 includes a shaped keyway 56 adjacent to the base member 12, and the wedge shaped shim or shim member 46 has a shaped cross-section sized to fit within the keyway 56.

In operation, the shim 46 is inserted into the keyway 56 and the lower surface 54 supported by the upper surface of the base member 12, the angled end face 50 moved into juxtaposition with the lower end portion of the resilient clip 20, and the squared end 48 generally disposed in the plane of the gauge arm 14. Preferably, the angled end face 50 is complementary to the angle of the lower end portion of the resilient clip 20 and the shim 46 is snugly disposed in nested relation between the gauge arm 14 and the resilient clip 20. The bottom edge of the siding $S_2$ is supported on the upper surface 52 of the wedge shaped shim 46 and thus raised upwardly relative to the upper surface of the base member. The amount of overlap is now defined by the distance between the flange member 16 and the top surface of the wedge shaped shim 46.

Figure 12A:
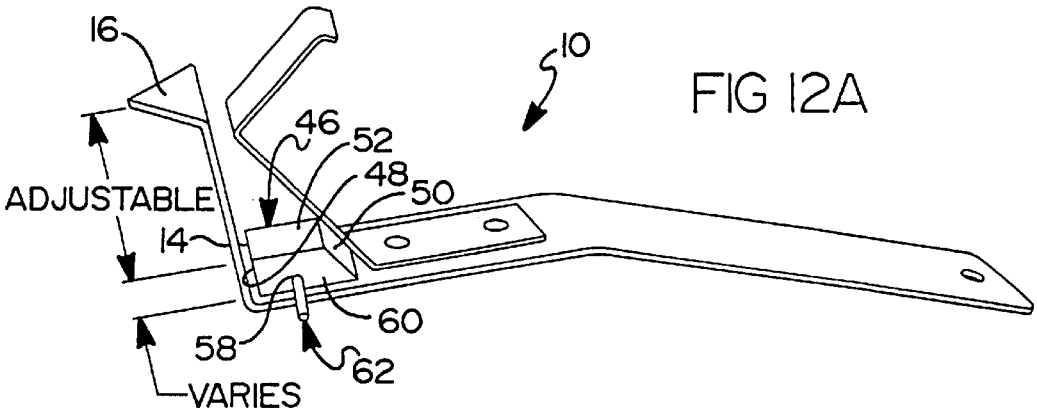
FIGS. 12A and 12B are perspective views, respectively, of the siding tool with a wedge shaped member for positioning the siding and a retention clip for releasably retaining the wedge on the tool.
Figure 12B:
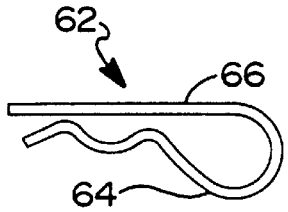

In FIGS. 12A and 12B, the siding gauge tool 10 includes the wedge shaped shim or shim member 46. However, the shim 46 is modified in that an axial bore 58 extends into one of the opposed sidewalls 60 of the shim, and a U-shaped retention clip 62 is provided for releasably securing the shim 46 to the tool. The retention clip 62 has a first leg 64 for engaging the lower surface of the base member and a second leg 66 for retaining fitment within the axial bore 58 and biasing the lower surface 54 of the shim 46 against the upper surface of the base member 12. In such manner, the upper surface 52 of the shim member 46 is upwardly facing for supporting the bottom edge of the siding $S_2$ (not shown) to be installed.

Desirably, depending on the thickness of the shim 46 (i.e., the distance between the wedge surfaces 52 and 54), the overlap between the siding panels $S_1$ and $S_2$ may be changed as desired.

Figure 13A:
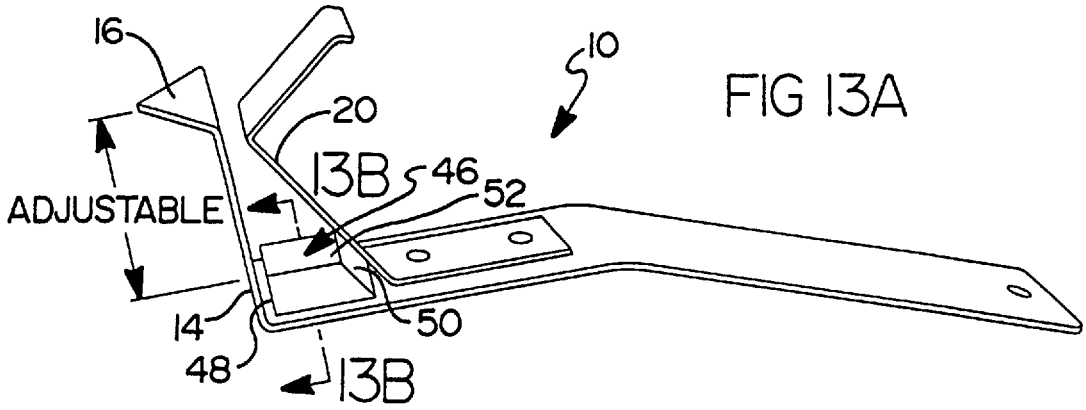
FIGS. 13A and 13B are, respectively, a perspective view of the siding tool with a wedge shaped member for positioning the siding, and a partial section view taken along line 13B—13B of FIG. 13A of a fastener for retaining the wedge on the tool.
Figure 13B:
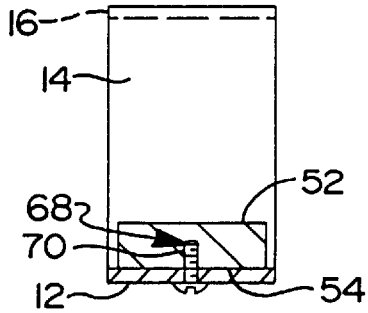

In FIGS. 13A and 13B, the siding gauge tool 10 includes the wedge shaped shim or shim member 46 and the tool 10 is modified to include a threaded fastener 68 for releasably securing the shim 46 to the base member 12. In particular, the threaded fastener 68 includes a threaded stem 70 disposed in threaded engagement with a bore provided in the base member 12 and with the shim member 46. So secured, the lower and upper surfaces 54 and 52 of the wedge shaped shim 46 are abutting and spaced from the upper surface of the base member.

Figure 14:
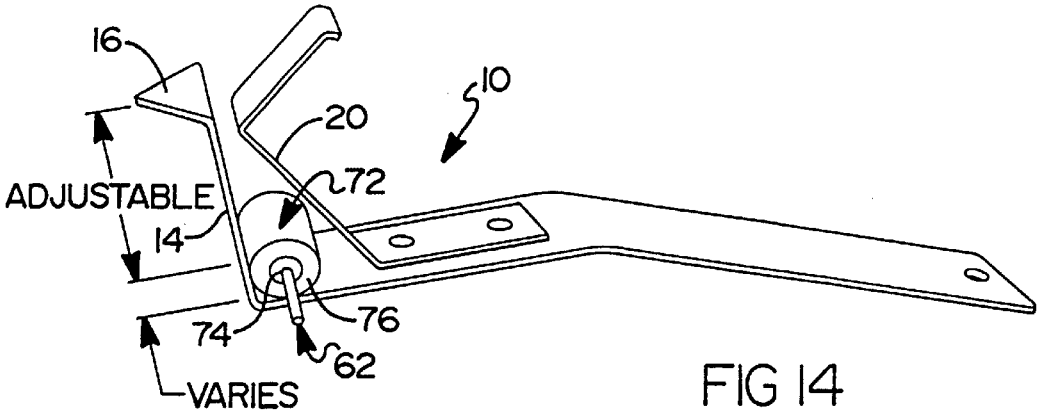

In FIG. 14, the siding gauge tool 10 includes a shim or shim member 72 in the form of a cylindrical spool that has an axial bore 74 provided in an endwall 76 of the spool. Preferably, the axial bore is disposed at the geometrical center of the cylinder. As illustrated and in the manner described herein above in connection with FIG. 12, the U-shaped retention clip 62 releasably secures the spool 72 to the tool. In particular, the first leg 64 engages the lower surface of the base member and the second leg 66 is received in retaining fitment within the axial bore 74. The retention clip 62 operates to bias the spool or shim 72 and a lower surface thereof against the upper surface of the base member. In such manner, the spool provides an upper surface that faces upwardly for supporting the bottom edge of the siding $S_2$ to be installed. Desirably, depending on the diameter of the spool or shim 72, the overlap between siding panels may be changed.

Figure 15B:
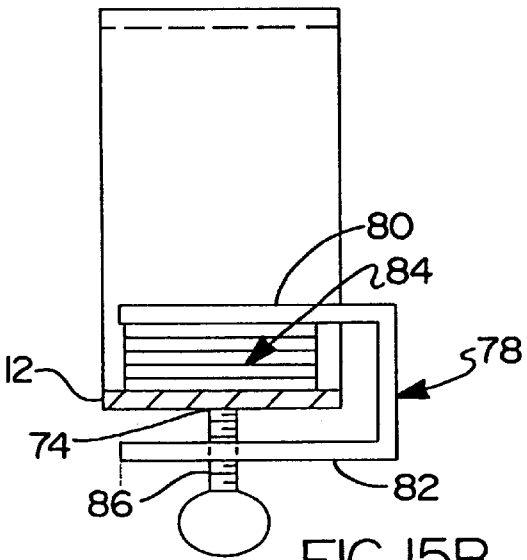
FIGS. 15A and 15B are, respectively, a perspective and an elevation view, partially in section and taken along line 15B—15B of FIG. 15A, of the siding tool and a shim arrangement including a C-shaped bracket that may be used in combination with shim plates to change the amount of overlap between siding to be installed and previously installed siding to be changed.
Figure 15A:
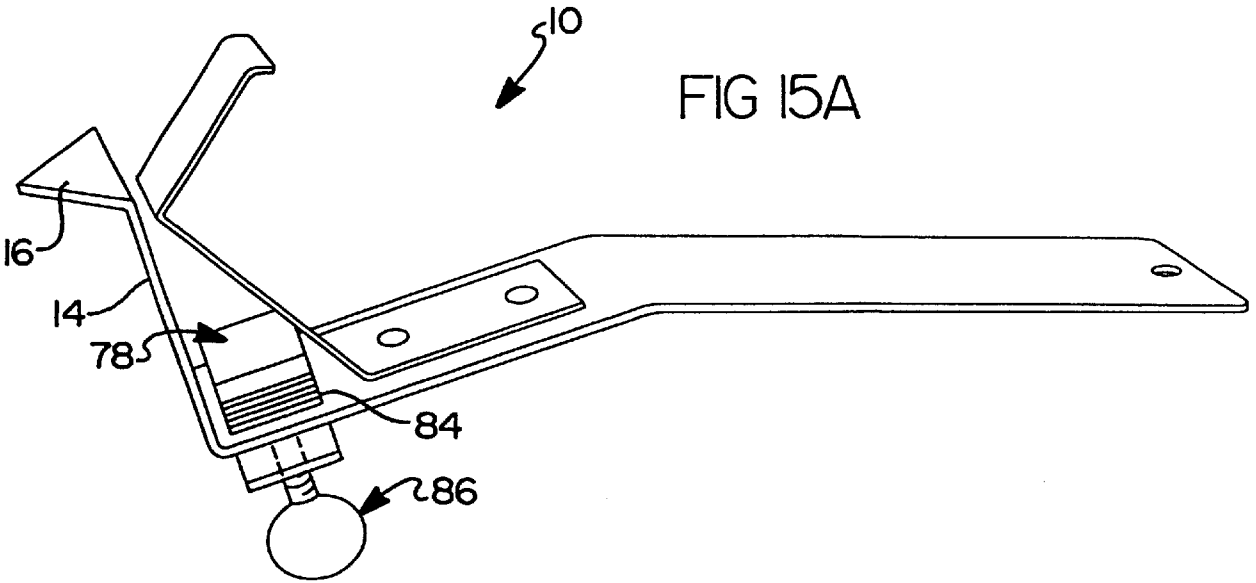

In FIGS. 15A and 15B, the siding gauge tool 10 is provided with a C-shaped bracket 78 having upper and lower legs 80 and 82, respectively, in juxtaposition with the upper and lower surfaces of the base member 12, a stack of shim plates 84 of predetermined thickness(-es) are disposed between the upper leg 80 of the bracket 78 and the upper surface of the base member 12, and a threaded member 86 operably connects the bracket to the tool. The upper leg 80 of the bracket 78 supports the bottom edge of the siding $S_2$ to be installed (not shown). The threaded member 86 includes a threaded stem or shaft 88 that is threadably connected to the lower leg 82 of the bracket 78 and includes a free end 90 that operably engages the lower surface of the base member 12. Rotation of the threaded shaft 88 relative to the lower leg 82 advances the free end 90 of the shaft 88 towards or away from the base member, depending on the direction of rotation. Importantly, rotation that causes the shaft 88 to advance towards the base member 12 causes the free end 90 to drive the upper leg 80 of the bracket 78 towards the base member 12 and against the topmost of the shim plates 84. Sufficient rotation of the shaft 88 brings the upper leg 80 and the base member 12 into clamping relation with the stack of shim plates 84.

As shown, a plurality of shim plates 84 of predetermined thicknesses are placed between the upper leg 80 and the base member 12 and clamped therebetween whereby to change the gauge distance and the overlap between successive siding panels. Of course, even if no shim plate 84 is employed, the upper leg 80 of the bracket may be of a predetermined thickness and function as a shim plate when brought into clamping relation with the base member.

Although not shown, one skilled in the art would appreciate that instead of pulling or otherwise drawing a siding support plate (i.e., the upper leg 80) towards the base member 12, the free end of a threaded screw member could be used to drive a siding support plate away from the base member. In this regard, a screw-operated jack is threadably connected to the base member with the free end of the jack operably connected to the lower surface of the support plate. Rotation of the jack relative to the base member causes the support plate and the siding edge supported on the upper surface thereof to be incrementally moved upwardly, or downwardly, depending on the direction of rotation of the jack.

In these siding installation tools, the gauge arm has a length such that when the flange portion of the tool used to install a first piece of siding rests on the top edge of the previously installed piece, the gauge arm and base member position the bottom edge of the siding being installed so as to overlap the top edge of a previously installed piece of siding. The gauge arm is adapted to rest against the exterior surface of the previously installed piece of siding and the flange portion extends transversely to the arm portion by an amount that is less than the predetermined thickness of the siding.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed is:

1. A tool for assisting in the installation of horizontally overlapping boarding on a vertically disposed wall of a building or like structure, each board having a predetermined thickness, an upper edge portion, a lower edge portion, an interior face and an exposed exterior face extending between the upper and lower edges thereof, said tool comprising: an elongate base portion having an upper surface and opposite end portions, one and the other of said end portions forming, respectively, a grippable handle and a board support, an arm portion connected to and extending generally at a right angle from the upper surface of said board support, said arm portion terminating in a transverse lip for temporarily resting the tool on the upper edge of a previously installed board, said lip extending generally at a right angle to and in a direction away from said arm portion and having an extension that is not greater than said predetermined thickness, and said arm portion being adapted to be abutted against the exterior face of the previously installed board and thereby position the base member so as to extend in generally perpendicular relation to the wall when installing boarding, and a resilient clip member carried on said base portion, said clip member extending from the upper surface of said board support and in a direction towards toward said arm portion, said clip member being movable towards and away from said arm portion wherein to define a throat to receive the board to be installed and clampingly engage the exterior face of the board, wherein one or more of said tools may be placed on and repositioned as desired along the lower edge portion of a first piece of boarding, and said piece of boarding is supported above a previously-installed piece of boarding.

2. The tool of claim 1, wherein the distance between said lip and said base member defines an overlap between said pieces of boarding.

3. The tool of claim 1, wherein the handle portion of said base member defines upper and lower surfaces and a free end, a nail locating gauge line transverse to the axis of the handle is provided in one of said surfaces at a location proximate to the free end of said handle, and a nail locating gauge aperture extends between said surfaces at a location between said free end and said gauge line, wherein the gauge line is adapted to be aligned with an edge of a board to be installed whereby to position the nail gauge aperture on the boarding being installed.

4. A tool for assisting in the installation of elongated generally rectangular shaped boarding in horizontally overlapped relation on a vertically disposed wall, each board being of predetermined thickness and having opposed interior and exterior faces, said tool comprising:

an elongated base member having opposite end portions disposed along an axis and adapted to be positioned in generally perpendicular relation to the wall when installing a board, wherein one and the other respective end portions of said base member form a handle portion to hold and manipulate the tool and a support portion to support the board in generally perpendicular relationship to the base member, an upwardly open resilient clamp extending generally perpendicularly from said one end portion of said base member, said clamp being adapted to receive a lower edge portion of and clampingly engage the faces of the board to be installed, and said clamp being slidable relative to said lower edge portion, a first gauge associated with said clamp to position the lower edge of the board to be installed in overlapped relation to the top edge of a previously installed board, said first gauge comprising a lip that is spaced from said base member and by a predetermined distance and adapted to be non-fixedly rested on the upper edge of the previously installed board, and a second gauge associated with the handle portion of said base member for locating nail attachment points on the edge portions of the board to be installed.

5. The tool as claimed in claim 4, wherein said first gauge comprises a generally planar gauge plate adapted to be supported against the exterior surface of the previously installed board, wherein said gauge plate has a first end portion connected to said lip and a second end portion connected to said one end of said base member, and wherein said lip and base member are disposed at right angles to the gauge plate and extend in opposite directions from one another and said clamp.

6. The tool as claimed in claim 5, wherein said clamp member comprises a first and a second arm member, the arm members projecting upwardly from the base member with the first arm member comprising said gauge plate and the second arm member comprising a resilient spring beam, the upward end portion of said spring beam being normally biased towards but deflectable away from the gauge plate.

7. The tool as claimed in claim 6, wherein the upward end portion of said spring beam defines a generally V-shaped knee, the outward extension of the knee defining an inlet for directing the board into the clamp and the apex of the V-shaped knee engaging the board to be installed.

8. The tool as claimed in claim 6, wherein the deflectable upward end portion of said spring beam includes a flat face, the flat face being adapted to seat against the exterior surface of the board to be installed once received in the clamp.

9. The tool as claimed in claim 6, wherein the deflectable upward end portion of said spring beam includes a tube of generally hexagonal cross-section and transverse to the axis of the handle, the tube having a plurality of flat faces with one of said flat faces being adapted to be biased into engagement with the flat exterior surface of the board to be installed.

10. The tool as claimed in claim 4, wherein said second gauge comprises a nail locating gauge aperture and a gauge line in said handle portion at remote to said first gauge, said gauge line being alignable with a selected edge of the board being installed for positioning the gauge aperture relative to the board, and said gauge aperture being sized to receive a marker for marking positions on the board or a drill bit for drilling holes through the board, the positions and holes representing locations for receiving installation nails.

11. The tool as claimed in claim 10, wherein the free end of said handle portion is of a predetermined thickness and adapted to space the lateral edge of a board being installed in spaced juxtaposed relation to the lateral edge of a previously installed board, the spacing between the edges defining a caulking receiving cavity.

12. A method of installing elongated generally rectangular boarding material to a wall in horizontally overlapped relation by using a pair of installation tools, each board having opposed faces, and opposed upper and lower edge portions and opposed lateral edge portions, each tool comprising an upwardly openable U-shaped clamp member for clamping and supporting the lower edge portion of a board to be installed, a lip extending from the clamp for resting the tool and the board to be installed on the top edge of a previously installed board, a handle that is connected to the clamp and has a free end for manipulating the clamp, the handle including a gauge aperture and a gauge line for positioning the gauge aperture relative to a selected edge of the board, the method comprising the steps of:

attaching a first board to the wall with the elongated upper edge portion thereof extending generally horizontally, clamping the clamp members of the first and second installation tools against the elongated lower edge portion of a second board to be installed, resting the lip members of the first and second installation tools on the upper edge of the first board such that the lower edge portion of the second board is generally horizontally extending and in overlapped relation to the upper edge portion of the first board, tacking the upper edge portion of the second board to the wall, removing the installation tools, positioning the gauge line and associated gauge aperture relative to at least one of the upper and lower edge portions of the second board, said positioning including aligning the gauge line with the edge selected, locating the gauge aperture on the second board, and marking the location, and driving installation nails through the nail locations marked, the nails extending through the second board and into the wall.

13. The method of claim 12, including the steps of clamping the first and second tools to the lower edge portion of a third board to be installed, resting the lips of the tools on the upper edge of the first board and positioning lateral edges of the second and third boards so as top be in juxtaposed relation, inserting the free end of the handle between the juxtaposed edges, abutting the edges against the free end, and removing the handle to provide a cavity therebetween.

14. The method of claim 13, including the step of successively positioning the gauge line along one and the other of said lateral edges of said second and third boards, said positioning aligning the gauge line and locating the gauge aperture inwardly of the respective lateral edge wherein to mark nail receiving locations in the respective boards.

15. The method of claim 13, wherein the step of marking includes inserting a drill bit into the gauge aperture and drilling in situ a hole through the board.

16. The method of claim 13, the step of positioning includes successively aligning the gauge line with the upper and the lower elongated edges of the second board, the elongated lower edge of the second board being overlapped with the elongated upper edge of the first board, successively locating the gauge aperture relative to the upper and lower edges, marking the nail installation locations relative to each of the boards, and driving nails into the locations marked, the nails passing through overlapped portions of the first and second board and the upper portion of the second board and into the wall.

17. The method of claim 13, following the step of creating a cavity, the step of inserting caulking material into the cavity.

18. The method of claim 13, wherein the positioning step includes locating and marking nail gauge apertures on the bottom edge portion of the tacked board, and the driving step includes driving a nail substantially simultaneously through the overlapped edge portions of the boards and into the wall.

19. A removable tool for installing elongated building siding to a wall, said siding being of a predetermined thickness and having laterally spaced top and bottom edges and opposed generally planar surfaces, said tool comprising:

a base member having first and second end portions, an upper surface for supporting the bottom edge of a piece of siding to be installed, and a lower surface;

a gauge arm of predetermined length connected to and extending generally at a right angle from the first end portion of said base member, said gauge arm terminating in a flange member of a length less than the thickness of a previously installed piece of siding for resting on the top edge of the previously installed piece of siding, said flange member extending generally at a right angle from said gauge arm and in a direction away from the second end portion of said base member, the distance between said flange member and base member determining the amount of overlap between the bottom edge portion of a piece of siding to be installed and the top edge portion of the previously installed piece of siding;

a resilient clip member connected to the second end portion of said base member and extending towards said gauge arm, said clip member terminating in a deflectable free end for engaging and biasing the siding to be installed towards the gauge arm; and a handle connected to the base member for releasably positioning the base member into supporting engagement with the bottom edge of the siding to be installed, said handle being generally disposed at a right angle to said gauge arm and spaced from the deflectable free end of said clip member, wherein one or more of said tools may be placed on the bottom edge of a first piece of siding so that the first piece of siding is releasably captured between said clip member and said gauge arm, and the piece of siding can then be placed at an appropriate position above a previously installed piece of siding with the flange member removably resting on the top edge of the previously installed piece of siding.

20. The tool of claim 19, further comprising means for changing the amount of overlap between the bottom edge of a piece of siding being installed relative to the top edge portion of the previously installed piece of siding by reducing the distance between the upper support surface of the base member and the flange member.

21. The tool of claim 20, wherein said means for changing the amount of overlap comprises a shim of predetermined thickness, the shim being nested between the gauge arm and the resilient clip and cooperating to space the bottom edge of the siding from the upper surface of the base member, the shim having lower and upper surfaces with the lower surface of the shim being supported on the upper surface of the base member and the upper surface of the shim being spaced upwardly from the base member and positioned for supporting the bottom edge of a piece of siding to be installed.

22. The tool of claim 21, wherein said gauge arm includes a shaped keyway adjacent to said base member, and said shim is generally wedge shaped and has opposed first and second endwalls that are squared and angled, said shim being sized to fit said keyway whereby to be in juxtaposition with the upper surface of said base member and to position the squared and angled endwalls, respectively, in juxtaposition with the gauge arm and the lower portion of the resilient clip.

23. The tool of claim 20, wherein said tool further comprises means for releasably securing the shim to the base member.

24. The tool of claim 23, wherein said shim comprises a cylindrical spool which has an axial bore therein, and said means for releasably securing comprises a resilient U-shaped retention clip, said clip having a first leg for engaging the lower surface of said base member and a second leg for retaining fitment within the axial bore and biasing the shim against the upper surface of said base member.

25. The tool of claim 20, wherein said shim comprises a wedge shaped member having generally planar upper and lower surfaces and an angled face extending between the shim surfaces, the angled face being complementary to and disposed in juxtaposition with a lower portion of the resilient clip.

26. The tool of claim 25, wherein said wedge shaped shim includes opposed sidewalls and an axial bore which extends into one of said sidewalls, and further comprising a U-shaped retention clip for releasably securing the shim to said tool, the clip having a first leg for engaging the lower surface of the base member and a second leg for retaining fitment within the axial bore and biasing the shim against the upper surface of the base member.

27. The tool of claim 25, further comprising means for releasably securing the shim to the tool, the means for releasably securing comprising a threaded stem disposed in threaded engagement with the base member and the shim.

28. The tool of claim 20, wherein the means for changing the amount of overlap comprises:

a support plate having an upper surface for supporting the bottom edge of the siding to be installed and a lower surface, and a screw-operated jack threadably connected to the base member and operably connected to the lower surface of the support plate, rotation of the jack relative to the base member causing the support plate and the siding thereon to move upwardly or downwardly depending on the direction of rotation of the jack.

29. The tool of claim 20, wherein the means for changing the amount of overlap comprises a C-shaped bracket having upper and lower legs, respectively, in juxtaposition with the upper and lower surfaces of the base member, the upper leg of the bracket being of a predetermined thickness and positioned for supporting the bottom edge of the siding to be installed, and a threaded member having a shaft portion threadably connected to the lower leg and a free end adapted to engage the lower surface of the base member, wherein rotation of the threaded member forces the free end thereof towards or away from the base member depending on the direction of rotation with rotation in the direction of the base member causing the free end to drive the upper leg of the bracket towards the base member and the lower leg towards the base member and clamped relation therewith.

30. The tool of claim 29, wherein the means for changing the amount of overlap comprises at least one shim plate of predetermined thickness disposed between the upper leg of the bracket and the base member, the shim plate being clamped between the upper leg and the base member upon rotation of the threaded member in the direction of the base member.

31. The tool of claim 30, wherein the means for changing the amount of overlap comprises a set of shim plates of predetermined thicknesses.

32. The tool of claim 20, comprising a predrill gauge aperture and a gauge line for positioning the gauge aperture, said gauge line and gauge aperture being disposed in the handle of said tool.

33. The tool of claim 19, wherein said arm portion has a length such that when said flange portion of the tool used to install said first piece of siding rests on the top edge of the previously installed piece, the gauge arm and base member position the bottom edge of the siding being installed so as to overlap the top edge of a previously installed piece of siding.

34. The tool of claim 19, wherein said arm portion is adapted to rest against the exterior surface of the previously installed piece of siding and said flange portion extends transversely to the arm portion by an amount that is less than the predetermined thickness of the siding.

35. A removable tool for installing elongated building siding to a wall, said siding having top and bottom edge portions and a predetermined thickness, said tool comprising:

an elongate base portion having first and second end portions and an upper surface for supporting the bottom edge portion of a piece of siding to be installed;

an arm portion connected to and extending generally at a right angle from the first end portion of said base portion, said arm portion terminating in a flange portion for resting on the top edge of a previously installed piece of siding, said flange portion extending generally at a right angle from said arm portion and in a direction away from the second end portion of said base portion;

a resilient clip member carried on the second end portion of said base portion, said clip member extending toward said arm portion and terminating in a deflectable free end; and a handle for positioning the base portion against the bottom edge portion of said siding to be installed, said handle being spaced from the deflectable free end of said clip member;

wherein one or more of said tools may be placed on the bottom edge of a first piece of siding so that the first piece of siding is releasably captured between said clip member and said arm portion, and the piece of siding can then be placed at an appropriate position on a wall above a previously-installed piece of siding, so that said flange portion removably rests on the top edge of the previously installed piece.

36. The tool of claim 35 wherein said arm portion has a length such that when said flange portion of the tool used to install said first piece of siding rests on the top edge of the previously installed piece, the arm portion and base of the tool positioning the bottom edge of the siding being installed so as to overlap the top edge of a previously installed piece of siding.

37. The tool of claim 35 wherein said arm portion is adapted to rest against the exterior surface of the previously installed piece of siding and said flange portion extends transversely to the arm portion by an amount that is less than the predetermined thickness of the siding.

* * * * *